US008356425B2

(12) United States Patent
Polegato Moretti et al.

(10) Patent No.: US 8,356,425 B2
(45) Date of Patent: Jan. 22, 2013

(54) BREATHABLE WATERPROOF SOLE FOR SHOES

(75) Inventors: Mario Polegato Moretti, Crocetta del Montello (IT); Antonio Ferrarese, Isola Della Scala (IT); Bruno Mattioni, Udine (IT)

(73) Assignee: GEOX S.p.A., Montebelluna (IT)

( * ) Notice: Subject to any disclaimer, the term of this patent is extended or adjusted under 35 U.S.C. 154(b) by 1079 days.

(21) Appl. No.: 10/585,085

(22) PCT Filed: Dec. 27, 2004

(86) PCT No.: PCT/EP2004/014717

§ 371 (c)(1),
(2), (4) Date: Apr. 30, 2007

(87) PCT Pub. No.: WO2005/063069

PCT Pub. Date: Jul. 14, 2005

(65) Prior Publication Data

US 2007/0271815 A1 Nov. 29, 2007

(30) Foreign Application Priority Data

Dec. 30, 2003 (IT) ..... PD2003A0312

(51) Int. Cl.
*A43B 7/06* (2006.01)
*A43B 23/07* (2006.01)
*A43B 13/12* (2006.01)

(52) U.S. Cl. ..... 36/3 B; 36/3 R; 36/30 R; 36/98; 428/317.9

(58) Field of Classification Search ..... 36/98, 3 R, 36/3 B, 3 A, 30 R, 25 R; 428/319, 319.7, 428/316.6, 317.9, 315.5, 315.7
See application file for complete search history.

(56) References Cited

U.S. PATENT DOCUMENTS 3,570,149 A * 3/1971 Kogert et al. ..... 36/84
4,321,721 A * 3/1982 Painter et al. ..... 12/146 C
4,833,172 A * 5/1989 Schwarz et al. ..... 521/62
4,877,679 A * 10/1989 Leatherman et al. ..... 442/58
5,032,450 A * 7/1991 Rechlicz et al. ..... 428/196
5,203,793 A * 4/1993 Lyden ..... 36/88
5,437,900 A * 8/1995 Kuzowski ..... 428/36.1

(Continued)

FOREIGN PATENT DOCUMENTS

EP 0 275 644 7/1988

(Continued)

OTHER PUBLICATIONS

U.S. Appl. No. 10/565,541, filed Jan. 23, 2006, Polegato Moretti.

(Continued)

*Primary Examiner* — Jila M Mohandesi
(74) *Attorney, Agent, or Firm* — Oblon, Spivak, McClelland, Maier & Neustadt, L.L.P.

(57) ABSTRACT

A waterproof breathable sole for shoes, which comprises, for at least part of its extension, at least two structural layers, a lower one provided with a supporting structure so as to form the tread, and an upper one that is permeable to water vapor. The lower layer has portions that are open onto the upper layer. A coating obtained by means of a plasma deposition treatment for waterproofing is provided on the upper layer. A layer is thus obtained that has structural functions and characteristics of resistance to damage and is at the same time waterproof and breathable.

25 Claims, 4 Drawing Sheets

U.S. PATENT DOCUMENTS

| | | | | |
|---|---|---|---|---|
| 5,570,161 | A * | 10/1996 | Andrews et al. | 399/98 |
| 5,746,012 | A * | 5/1998 | Caletti et al. | 36/3 B |
| 5,918,382 | A | 7/1999 | Haderlein et al. | |
| 5,983,524 | A * | 11/1999 | Polegato | 36/3 R |
| 6,389,711 | B1 * | 5/2002 | Polegato | 36/3 R |
| 6,412,193 | B1 * | 7/2002 | Chen | 36/14 |
| 6,508,015 | B1 * | 1/2003 | Rauch | 36/3 B |
| 6,839,984 | B2 * | 1/2005 | Polegato | 36/3 B |
| 6,986,183 | B2 * | 1/2006 | Delgorgue et al. | 12/146 C |
| 7,147,763 | B2 * | 12/2006 | Elrod et al. | 204/547 |
| 7,282,261 | B2 * | 10/2007 | Zhao et al. | 428/336 |
| 2002/0100187 | A1 * | 8/2002 | Polegato | 36/3 R |
| 2006/0064897 | A1 | 3/2006 | Polegato Moretti | |

FOREIGN PATENT DOCUMENTS

| | | |
|---|---|---|
| EP | 0 985 741 | 3/2000 |
| EP | 1 197 158 | 4/2002 |
| JP | 63-140437 | 6/1988 |
| JP | 63-115304 | 7/1988 |
| JP | 06-299331 | 10/1994 |
| JP | 10-234414 | 9/1998 |
| JP | 2000-166606 | 6/2000 |
| JP | 2000-175701 | 6/2000 |
| JP | 2002-524660 | 8/2002 |
| JP | 2003-521588 | 7/2003 |
| JP | 2003-235604 | 8/2003 |
| WO | WO 97/14326 | 4/1997 |
| WO | WO 01/12004 | 2/2001 |
| WO | WO 01/78542 | 10/2001 |
| WO | 2004 004504 | 1/2004 |

OTHER PUBLICATIONS

Japanese Office Action issued Sep. 21, 2010, in Patent Application No. 2006-546085 (with English-language translation).

European Search Report as received in the corresponding European Patent Application No. 09157715.5-2318/2168448 dated Jul. 1, 2011.

Office Action dated Feb. 14, 2012 as received in the corresponding European Patent Application No. 04 804 307.9-2318.

Dirk Hegemann, et al. "Plasma Treatment of Polymers to Generate Stable, Hydrophobic Surfaces", Plasmas and Polymers, vol. 6, No. 4, Dec. 2001, pp. 221-235.

U.S. Appl. No. 13/091,355, filed Apr. 21, 2011, Polegato Moretti, et al.

Office Action issued Mar. 13, 2012 in Japanese Patent Application No. 2006-546085 (English translation only).

Office Action as received in the corresponding Japanese Patent Application No. 2006-546085 dated Oct. 23, 2012.

* cited by examiner

BREATHABLE WATERPROOF SOLE FOR SHOES

CROSS-REFERENCE TO RELATED APPLICATIONS

This application is a 371 of PCT/EP04/14717 filed Dec. 27, 2004 and claims the benefit of Italian application PD2003A000312 filed Dec. 30, 2003.

TECHNICAL FIELD

The present invention relates to a breathable waterproof sole for shoes.

BACKGROUND ART

The present invention also relates to a shoe manufactured with such sole.

It is known that the footwear market is continuously evolving in order to seek and identify technical solutions that ensure optimum comfort for the end-user of the shoe.

As is well known, the comfort of a shoe depends not only on a correctly anatomical fit but also on correct outward permeation of the water vapor generated inside the shoe due to perspiration, in order to avoid the so-called "wet foot" phenomenon.

However, this water vapor permeation must not compromise the waterproofness of the shoe, and therefore solutions have been studied which entrust permeation to the upper or to the sole.

Most of the perspiration of the foot is produced at the interface between the sole of the foot and the sole of the shoe, and it is evident that the sweat that forms there is unable to evaporate and therefore condenses on the insole on which the foot rests. Only a minimal fraction of the sweat evaporates through the upper.

This problem is particularly important in shoes that have a plastic sole; in these cases, permeation through the sole is completely prevented (in the case of leather soles there is instead a small amount of permeation).

Solutions to the problem are provided by breathable and waterproof soles, which accordingly allow permeation of the sweat generated at the sole of the foot.

One of these solutions is disclosed in U.S. Pat. No. 5,044,096 and in EP-0382904 and consists in dividing the plastic sole into two layers with through holes and in interposing a waterproof breathable membrane (for example made of a material such as Gore-Tex® or the like), which is joined perimetrically and hermetically to the two layers, so as to allow no infiltrations of water.

This solution ensures correct permeation as well as an effective exchange of heat and water vapor between the environment inside the shoe and the outside environment, at the same time ensuring the necessary impermeability with respect to external moisture and water.

These perforated soles provided with waterproof and breathable membranes have certainly constituted a considerable innovation with respect to what was previously available.

Nonetheless, there are still aspects that can be improved, particularly in relation to the area occupied by the holes.

As is evident, the larger the total hole area, the greater the breathability; however, on the other hand, the number of holes provided in the tread and their diameter must be limited in order to prevent pointed foreign objects from entering through the holes and penetrating until they damage or pierce the membrane, which is delicate, since in practice it is a film and lacks adequate structural characteristics.

Such membrane is in fact continuously subjected to the compression performed by the foot, and therefore even a body that is not particularly pointed that penetrates one of the holes may cause damage without excessive difficulty.

One solution that has been adopted is to use a breathable protective layer, such as a felt, between the tread and the membrane.

Moreover, dirt, dust and pebbles may wedge in the holes of the tread, obstructing them and thus limiting breathability.

A different solution with respect to the use of a waterproof and breathable membrane lacking structural characteristics is disclosed in U.S. Pat. No. 6,508,015.

This patent discloses a sole that is provided by a structure with two layers, respectively an elastic upper layer, which is permeable to water vapor, and a lower layer, which covers less than 70% of the upper layer, which also acts as a support and as a tread.

The permeation activity of the sole is ensured by the microporous structure of the upper layer and by the shape of the lower layer.

The microporous structure of the upper layer is provided for example by means of sintered plastic material or by means of woven or non-woven structures made of synthetic material.

However, this layer does not have strictly waterproof characteristics; for this purpose, the patent mentions the possibility of rendering this layer hydrophobic, for example by treating the sintered polyethylene in high or ultra-high molecular weight conditions.

Another possibility for the waterproofing disclosed in the patent is to add, above the upper layer, an additional layer formed by a waterproof membrane.

Although this described solution solves the problem of the breathable area of the sole, which is large, it does not adequately meet the requirement of waterproofing said sole.

It has in fact been found that the hydrophobic treatment of the sintered material does not make the upper layer sufficiently waterproof, especially in the case of large amounts of water.

Moreover, the idea of coupling an impermeable membrane to the inner layer is not in itself sufficient to ensure perfect insulation from water, since infiltrations of water along the perimeter of the upper layer are possible.

Another problem that is linked to this type of sole is that the upper layer tends in any case to absorb considerable amounts of water ("sponge effect"), which is released over time, leading to evident soiling of the surfaces on which one walks.

This problem becomes more evident as the size of the pores of the material increases.

Already for pore dimensions of more than 5 μm, there is penetration of unclean water (dirty or soapy water): in this case, the surface tension is lower than the typical value of water (73 mN/mm).

DISCLOSURE OF THE INVENTION

The aim of the present invention is to provide a breathable waterproof sole for shoes that solves the problems noted in known soles.

Within this aim, an object of the present invention is to provide a breathable waterproof sole for shoes that uses a waterproof and breathable structural layer and at the same time ensures higher breathability than known shoes.

Another object of the present invention is to provide a breathable waterproof sole for shoes that is resistant to wear and damage.

Another object of the present invention is to provide a breathable and waterproof sole for shoes that is composed of a smaller number of components than known soles.

Another object of the present invention is to provide a breathable and waterproof sole for shoes that can be manufactured with known systems and technologies.

This aim and these and other objects that will become better apparent hereinafter are achieved by a waterproof breathable sole for shoes comprising, for at least part of its extension, at least two structural layers, a lower one provided with a supporting structure so as to form the tread, and an upper microporous one that is permeable to water vapor, said lower layer having portions that are open onto said upper layer, said sole being characterized in that at least one of the two surfaces of said upper layer has a coating obtained by means of a plasma deposition treatment for waterproofing.

BRIEF DESCRIPTION OF THE DRAWINGS

Further characteristics and advantages of the invention will become better apparent from the description of some preferred but not exclusive embodiments thereof, illustrated by way of non-limiting example in the accompanying drawings, wherein.

WAYS OF CARRYING OUT THE INVENTION

Figure 1:
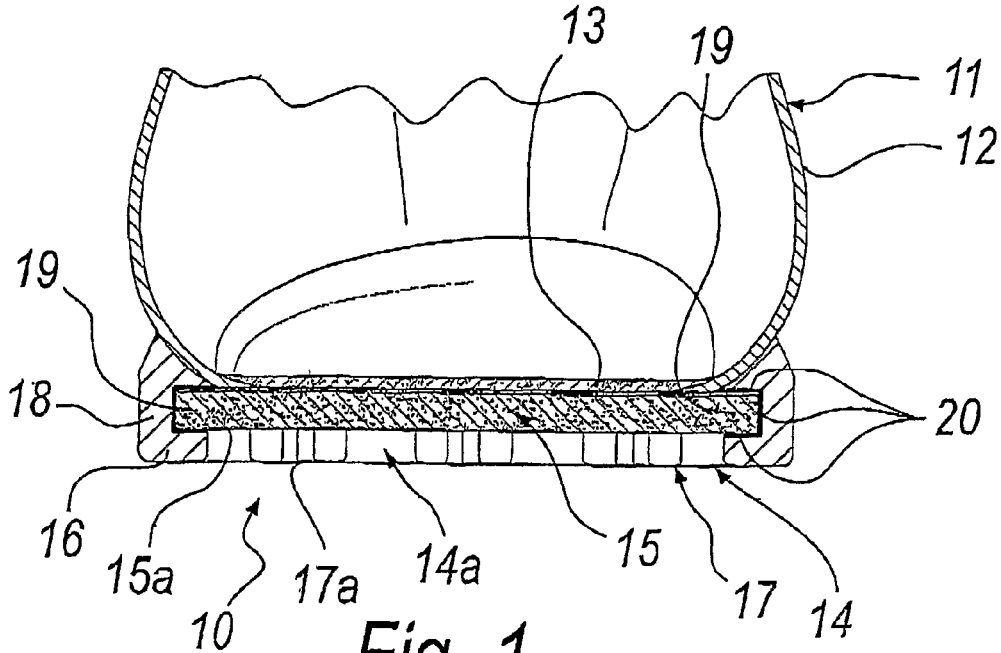
FIG. 1 is a transverse sectional view of a portion of a shoe with a sole according to the invention.
Figure 2:
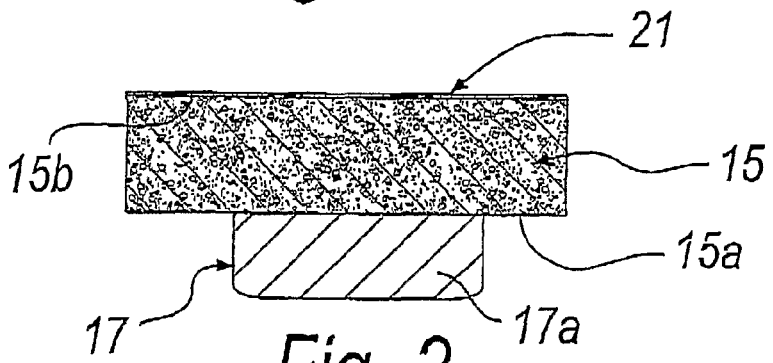
FIG. 2 is a transverse sectional view of a detail of a sole according to FIG. 1.

With reference to the figures, a first embodiment of the sole according to the invention is generally designated by the reference numeral 10.

FIG. 1 is a transverse sectional view of a shoe related to the region of the sole 10; this figure clearly shows that the sole 10 comprises, in this embodiment, two layers, which compose respectively a lower layer 14 and an upper layer 15 that is permeable to water vapor.

Both of the layers 14 and 15 are structural and therefore have a supporting function; in particular, the lower layer 14 has a supporting structure so as to form the tread of the sole 10, while the upper layer 15 forms the foot supporting base and has elasticity and flexibility characteristics.

In order to allow breathability of the upper layer 15, the lower layer 14 has portions 14*a* that are open onto the upper layer 15, so that it is exposed directly to the external environment; such open portions 14*a* are described in greater detail hereinafter.

The upper layer is microporous and is for example made of sintered plastics material.

Conveniently, the plastics material that is used can be any of polyethylene, polypropylene, polystyrene or polyester.

Optionally, the upper layer 15 can be constituted by any of a felt, a fleece, a fabric or mesh, made of synthetic material.

In order to ensure adequate permeability to water vapor and allow subsequent surface treatments of the upper layer 15 (as described hereinafter), the average width of the pores is comprised between 3 and 250 μm.

Preferably, the average width can be comprised between 3 and 5 μm.

The lower layer 14 is made of plastics, such as for example polyurethane.

The lower layer 14 is constituted by a perimetric skirt 16 that constitutes the outer edge of the sole, and by ground contact elements 17, which act as a support for the upper layer 15 (which otherwise would collapse within the perimeter of the skirt).

The spaces of the lower layer 14 that are comprised between the various ground contact elements 17 and between the ground contact elements and the skirt 16 form the portions 14*a*.

In this embodiment, the perimetric skirt 16 has a lateral portion 18 that includes a perimetric contour 19 of the upper layer 15 so as to form perimetric regions of mutual contact 20 between layers 14 and 15.

In this lateral portion 18, the upper layer 15 and the lower layer 14 are hermetically joined along their perimeter in order to avoid infiltrations of water.

Preferably, the coupling between the layers 14 and 15 occurs by overmolding the lower layer 14 onto the upper layer 15; in this case, hermetic complete coupling is ensured by the perfect adhesion provided by overmolding.

As an alternative, it is possible to use other production methods, such as for example adhesive bonding methods; in this case, however, the coupling of the upper layer 15 to the lower layer 14 provides for sealant in the perimetric regions of mutual contact 20.

The ground contact elements 17, in this described embodiment, are separated from the skirt 16 and are provided for example by overmolding directly on the lower surface 15*a* of the upper layer 15, so as to form in practice studs 17*a* that supports the upper layer 15 and ensure the grip of the sole 10.

Figure 5:
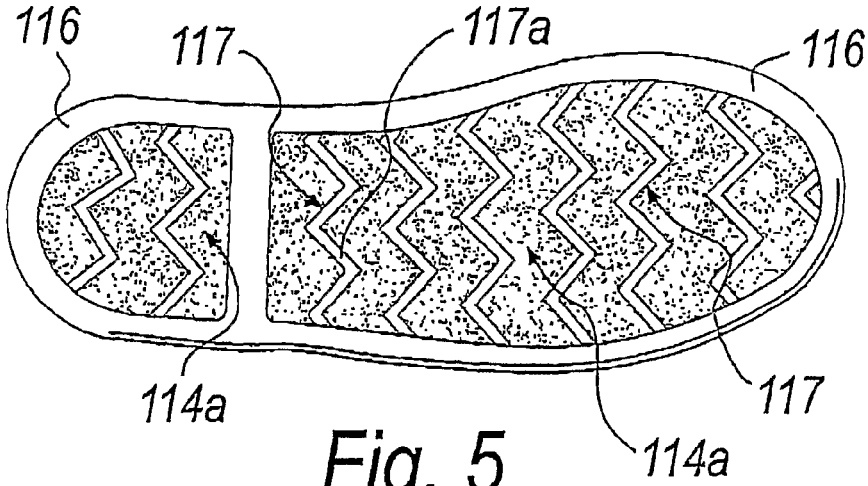
FIG. 5 is a plan view of another variation of the sole of FIG. 1.

Variations of these ground contact elements, now designated by the reference numeral 117 in FIG. 5, provide for example continuous transverse elements 117*a*, which are provided monolithically with the skirt 116.

The portions 114*a* are formed between the transverse continuous elements 117*a* and the skirt 116.

For correct permeation, it is important that the lower layer cover the smallest possible extent of the upper layer.

For example, conveniently, the lower layer can cover a percentage of the upper layer that is comprised between 30% and 70%.

The upper layer 15 has, on its upper surface 15*b*, a coating 21 obtained by means of a plasma deposition treatment, which allows waterproofing (and also maintains breathability).

Figure 3:
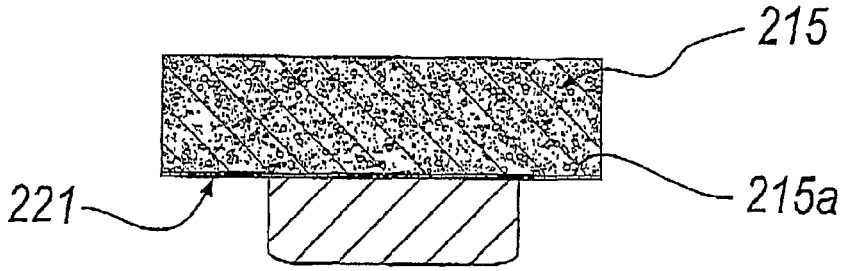
FIG. 3 is a view of a detail of a variation of the sole shown in FIG. 1.
Figure 4:
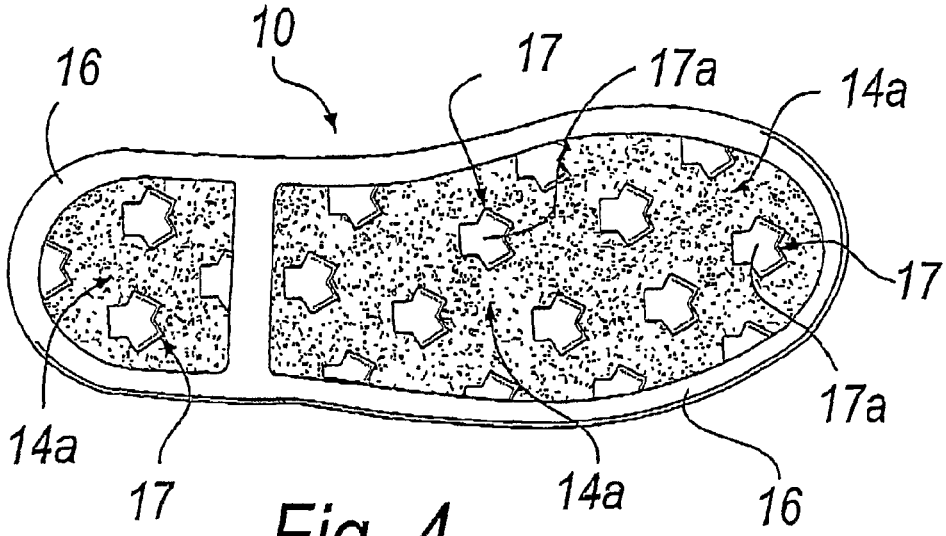
FIG. 4 is a plan view of the sole of FIG. 1.

As an alternative, as shown in FIG. 3, it is possible to provide a coating, designated by the reference numeral 221, which is obtained by means of a plasma deposition treatment on a lower surface 215*a* of a lower layer 215.

It is optionally possible to provide such coating on both of the surfaces of the lower layer 15,215.

The idea of coating by plasma deposition arises from the surprising experimental discovery that a vapor of a siloxane organic compound can be used to produce an ultrathin layer on a microporous supporting material by "cold plasma" polymerization in high vacuum at ambient temperature, providing waterproofing characteristics without altering the general characteristics and in particular the breathability characteristics of the supporting material.

A waterproof and breathable membrane can in fact be created by plasma polymerization for example of a monomer based on siloxane by depositing a layer of polymer (polysiloxane) on a microporous supporting material (made for example of polyethylene or polystyrene).

This deposition can also be performed for example by using oil-repellent and water-repellent fluoropolymers, such as those manufactured by DuPont and registered with the trade name Zonyl®.

Plasma is divided into hot and cold depending on the temperatures that it reaches; it is also divided into ambient-pressure plasma and vacuum plasma.

In a plasma process for obtaining a coating according to the present invention, a gaseous or vaporized precursor compound is introduced in a reaction chamber at a very low pressure (in vacuum conditions).

A plasma condition is generated by energizing the precursor within the reaction chamber by generating an electrical field.

The result is an ultrathin bonded layer of the polymer deposited on the entire surface of any substrate material introduced in the reaction chamber.

The plasma polymerization process is started and performed by means of an electrical field so as to achieve breakdown of the precursor of the deposition layer inside the reaction chamber.

Once breakdown has occurred, ions and reactive species are formed which begin and assist the atomic and molecular reactions that lead to the formation of thin films.

Layers created by plasma polymerization may use various configurations of electrical fields and different reaction parameters.

The thickness of the layer is controlled by selecting the polymerizable initial material and the reaction conditions, such as the monomer deposition time, the treatment time, the electrical frequency at which the reaction is performed, and the power that is used.

In the present invention, plasma polymerization is performed in vacuum.

The typical range of pressures is between $10^{-1}$ and $10^{-5}$ mbar.

The precursor is typically reacted in its pure state, by using a non-polymerizable inert gas, such as for example argon; such inert gas is used both as an inert diluent and as a carrier gas that assists polymerization of the precursor.

Other gases that can be used are oxygen, helium, nitrogen, neon, xenon and ammonia.

The precursor must have a vapor pressure that is sufficient to allow vaporization in a moderate vacuum.

A reaction sequence generally begins by loading the support material to be coated into the reaction chamber and subsequently bringing the chamber to the intended vacuum pressure.

The plasma generating discharge is produced and the vaporized precursor monomer is injected into the reaction chamber.

Collision of the monomer with the ions and electrons of the plasma allows polymerization of the monomer.

The resulting polymer is deposited on the exposed surfaces inside the chamber.

The properties of the film are not only a function of the structure of the monomer but are also a function of the discharge frequency, of the power used, of the flow-rate of the monomer and of the pressure.

Porosity, surface morphology and permeability may vary according to the reaction conditions.

An important variable in the plasma polymerization reaction is the rate of deposition of the polymer, which can be changed by means of the flow-rate of the monomer.

The deposition process ends when the intended thickness of deposited material is reached.

Thanks to the fact that the upper layer 15 is made of insulating material (for example, polyethylene is one of the most highly insulating materials known), in order to maintain the plasma conditions it is necessary to apply to the process a radiofrequency generator, so that the electrical field in the treatment oscillates with a frequency on the order of 13.56 MHz, with an applied electrical field power of 50-700 W and a vacuum level comprised between $10^{-1}$ and $10^{-5}$ mbar.

The microporous upper layer 15 must have an average pore width comprised between 3 and 250 μm.

As regards the duration of the treatment, it has been studied that for a precursor such as a siloxane monomer the optimum time is comprised substantially between 160 and 600 seconds; in particular, an optimum duration of substantially 420 seconds has been found.

Regardless of the plasma deposition treatment, it is further possible to render the upper layer 15 hydrophobic by treating for example the sintered polyethylene in high- or ultra-high molecular weight conditions.

Figure 6:
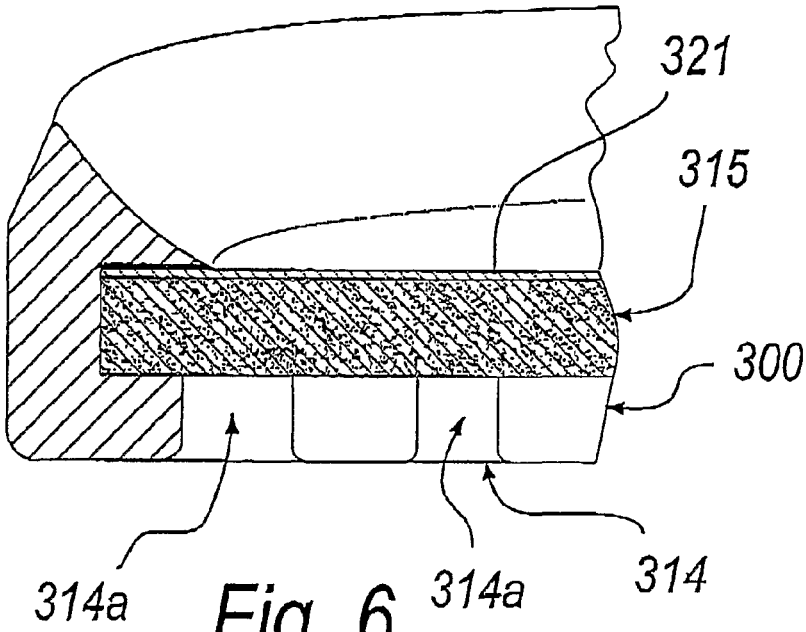
FIG. 6 is a transverse sectional view of a portion of a shoe with an embodiment of the sole according to the invention that is alternative with respect to the embodiments of the previous figures.

FIG. 6 is a view of a portion of a shoe with an alternative embodiment of a sole, generally designated here by the reference numeral 300, which uses a waterproof membrane 321.

In practice, as in the preceding case, the sole 300 comprises a lower structural layer 314 with a supporting structure so as to form the tread and an upper microporous structural layer 315 that is permeable to water vapor: the lower layer 14 is provided with portions **314*a* that are open onto the upper layer 315** in order to allow breathability.

The waterproof membrane 321 is coupled in an upward region to the upper structural layer 315.

The upper layer 315 has structural functions for supporting the foot and functions for protecting the waterproof membrane 321.

In this case, however, the upper layer 315 and the waterproof membrane 321 must be hermetically joined along their perimeter in order to prevent water infiltrations.

As already known, the waterproof membrane 321 can optionally be coupled (so as to withstand hydrolysis without compromising breathability), with a supporting mesh (not shown in the figures, since it is a known element) made of synthetic material.

The membrane 321 can be fixed to the upper layer 315, for example, by lamination directly onto the upper layer 315 or can be fixed subsequently by adhesive spots according to methods that are per se known.

As previously, the coupling between the lower layer 314 and the upper layer 315 with the membrane 321 coupled thereto preferably occurs by overmolding the lower layer 314 onto the assembly constituted by the upper layer 315 and the membrane 321; in this case, the hermetic coupling is ensured by the perfect adhesion provided by overmolding.

As an alternative, it is possible to use other production methods, such as for example adhesive bonding techniques; in this case, however, sealant is provided along the perimeter where the membrane makes contact with the directly overlying layer.

Figure 7:
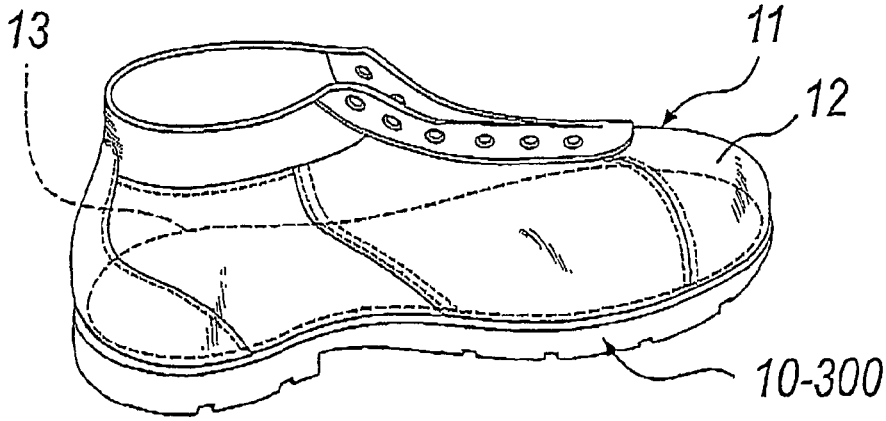
FIG. 7 is a perspective view of a shoe with a sole according to the invention.

FIG. 7 illustrates a shoe 11 that is constituted by a sole 10,300, as described in one of the previous examples, by an upper 12, and by an insole 13.

Figure 8:
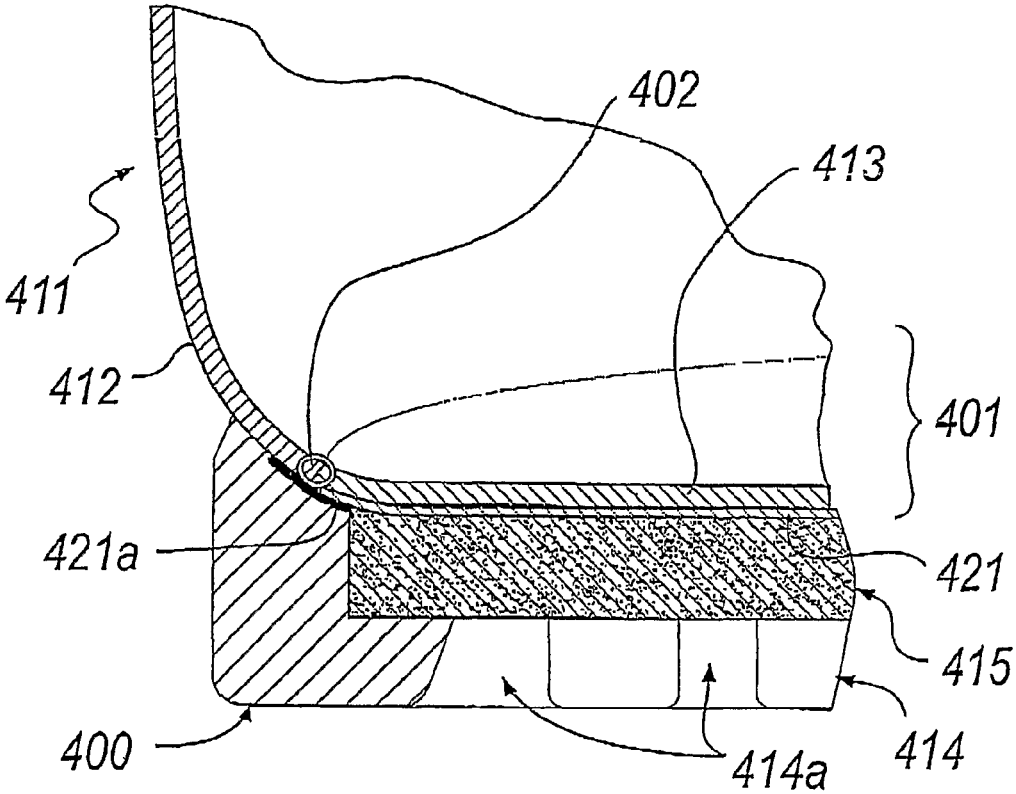
FIG. 8 is a transverse sectional view of a portion of another shoe according to the invention, which is alternative with respect to the shoes of the preceding figures.

FIG. 8 illustrates a breathable and waterproof shoe 411, which comprises an assembly 401 that wraps around the foot insertion region like a pouch and is constituted by a breathable upper 412 with which a waterproof membrane 421 is associated in a downward region.

A sole 400 is associated below the assembly 401 and comprises, like the sole examples described earlier, two component layers, respectively a lower layer 414 and an upper layer 415, which is microporous and permeable to water vapor.

Both of said layers 414 and 415 are structural and therefore have a supporting function; in particular, the lower layer 414 has a supporting structure so as to form the tread of the sole 400, while the lower layer 415 forms the foot supporting base and has elasticity and flexibility characteristics.

In order to allow breathability of the upper layer 415, the lower layer 414 has portions 414*a* that are open onto said upper layer 415, so that it is directly exposed to the outside environment.

In this embodiment, the assembly 401 is composed of the upper 412 and of a breathable or perforated insole 413, which is joined by means of stitches 402 to the edges of said upper 412 according to the per se known "strobel" or "ideal welt" structure so as to form a pouch.

In this embodiment, the waterproof membrane 421 adheres only to the insole 413 and can be applied for example by direct lamination onto the insole before sewing to the upper 412 or can be applied subsequently for example by spot gluing.

In order to avoid water infiltration problems, the assembly 401 comprises, along the perimeter of the waterproof membrane 421, a sealing area 421*a* that straddles the stitched seams 402 and said membrane 421, reaching the upper layer 415.

Figure 9:
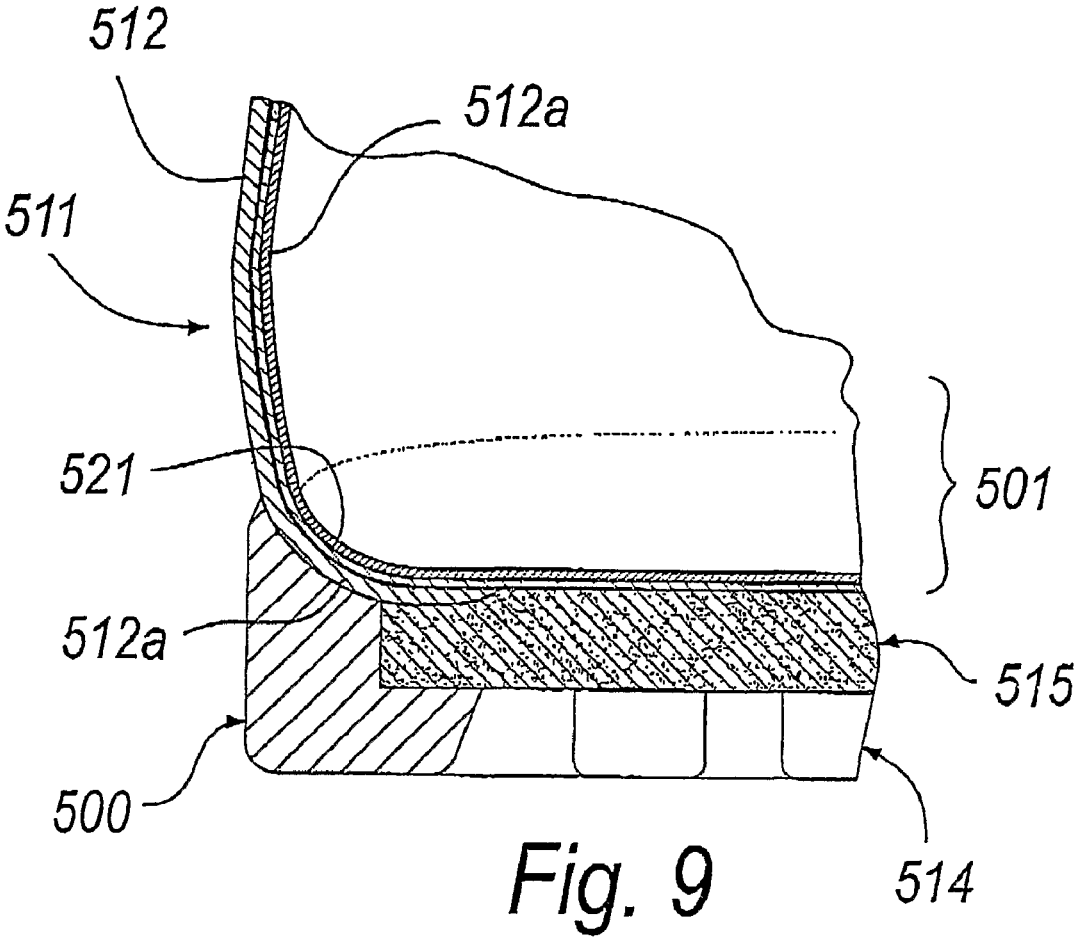
FIG. 9 is a transverse sectional view of a portion of another shoe according to the invention, which is alternative with respect to the shoes of the preceding figures.

An alternative embodiment with respect to the shoe 411 is described in FIG. 9 and is generally designated by the reference numeral 511.

The differences with respect to the embodiment of the shoe 411 substantially relate only to the part related to the assembly, here designated by the reference numeral 501, that surrounds in a pouch-like manner the foot insertion region and with which a sole 500 is associated in a downward region which is composed of a lower layer 514 and an upper layer 515 such as the ones described previously.

Such pouch is sealed and rendered waterproof according to known techniques.

The assembly 501 is composed of an upper 512, which is externally coupled to the sole 500 by means of its lower edges 512*a* and is internally coupled to a waterproof membrane 521, which forms a pouch for containing foot insertion.

The waterproof membrane 521 is fixed for example to the upper 512 by spot gluing, so as to avoid compromising breathability through said upper.

An inner sheet of fabric 521*a* is coupled to the waterproof membrane 521 toward the inside of the shoe and together with said membrane forms the inner lining of the shoe.

In this case also, the coupling of the assembly 501 to the sole 500 occurs by means of per se known techniques, such as for example direct overmolding of the sole, adhesive bonding, et cetera.

Advantageously, in all of the described embodiments (except for those in which another material is explicitly required for construction reasons), the upper microporous layer that is permeable to water vapor (15, 215, 315, 415, 515) can be made of leather.

In practice it has been observed that the invention thus described solves the problems noted in known types of sole for shoes; in particular, the present invention provides a breathable and waterproof sole that has a structural element, the upper layer, which in addition to performing foot supporting functions is also designed to ensure breathability and waterproofing, since it is directly exposed to the outside environment.

Waterproofing has been ensured by the coating of the upper layer obtained by means of the plasma treatment.

In this manner, the characteristic of waterproofing has been associated with a structural component of the sole (the upper layer) that has breathability characteristics.

The structural characteristic and the strength of the upper layer allows to prevent foreign pointed objects from penetrating to the point of damaging or piercing it and therefore from rendering the waterproofing substantially useless.

In this manner, it is possible to ensure a large surface (the part of the upper layer that is not covered by the lower layer) for breathability of the sole, considerably reducing the possibility of condensation of water vapor inside a shoe.

By using plasma deposition, the problems of conformity and adhesion of a thin film to a support are solved, since the polymer adheres to the support for a longer time than conventional spreading (typically, the waterproof membranes that are currently used are produced separately and then bonded by spot gluing or laminated or spread directly onto the support).

With this plasma deposition, it is possible to create an extremely thin deposition layer on the supporting material, even on the order of 100 Angstrom.

The selection of the sintered plastic material for providing said upper layer, moreover, allows the necessary flexibility of the sole and allows to overmold the tread in an optimum manner.

In one described embodiment, preference has been given to using, instead of coating by plasma deposition, a waterproof membrane coupled to the upper breathable layer.

In this case, the invention solves the problems of known shoes that use such sole structures, by joining perimetrically and hermetically the waterproof membrane and the upper breathable layer.

In the last three embodiments described, the invention has advantageously combined a supporting sole structure, which has large areas for vapor permeation toward the ground, with an assembly that forms a pouch for foot insertion that is completely breathable (both laterally and in a downward region) and is impermeable at least in the direction of the sole; in particular, in the shoes designated by the reference numerals 500 and 600, a pouch for foot insertion that is completely breathable and impermeable has been obtained.

In all of the embodiments provided with a membrane described above, the upper layer continues to have structural supporting functions as well as a membrane protection functions.

The invention thus conceived is susceptible of numerous modifications and variations, all of which are within the scope of the appended claims; all the details may further be replaced with other technically equivalent elements.

In practice, the materials used, so long as they are compatible with the specific use, as well as the dimensions, may be any according to requirements and to the state of the art.

The disclosures in Italian Patent Application no. PD2003A000312, from which this application claims priority, are incorporated herein by reference.

The invention claimed is:

1. A waterproof breathable sole for shoes, comprising, for at least part of its extension, at least two structural layers, wherein a first structural layer is a lower layer provided with a supporting structure so as to form a tread, and a second structural layer is an upper microporous layer that is permeable to water vapor, said lower layer having two, upper and lower surfaces and portions that are open onto said upper layer, and wherein at least one of two surfaces of said upper layer comprises a coating formed by plasma deposition treatment for waterproofing, wherein said lower layer is constituted by a perimetric skirt that constitutes an outer edge of the sole, and by ground contact elements, which are made so as to support said upper layer, and wherein spaces of said lower layer comprised between each one of said ground contact elements, and between said ground contact elements and said skirt, form said portions.

2. The sole according to claim 1, wherein said coating is provided on the upper surface of said upper layer.

3. The sole according to claim 1, wherein said coating is provided on the lower surface of said upper layer.

4. The sole according to claim 1, wherein said coating is provided both on the lower surface and on the upper surface of said upper layer.

5. The sole according to claim 1, wherein said upper layer and said lower layer are joined hermetically along a perimeter region thereof in order to avoid water infiltrations.

6. The sole of claim 5, wherein said upper layer is made of sintered plastic material.

7. The sole according to claim 6, wherein said sintered plastic material is polyethylene, polypropylene, polystyrene or polyester.

8. The sole according to claim 1, wherein said upper layer is selected from a group of materials comprising a felt, a fleece, a fabric and mesh made of synthetic material.

9. The sole according to claim 1, wherein said upper layer has an average pore width between 3 and 250 μM.

10. The sole according to claim 1, wherein said upper layer is hydrophobic.

11. The sole of claim 1, wherein said plasma deposition treatment is a high-vacuum cold plasma treatment.

12. The sole of claim 11, wherein said plasma deposition treatment is carried out with a radiofrequency generator so that a treatment electrical field oscillates with a frequency substantially between 13 MHz and 14 MHz.

13. The sole of claim 11, wherein said plasma deposition treatment is carried out with a radiofrequency generator so that a treatment electrical field oscillates with a frequency preferably on the order of 13.56 MHz.

14. The sole of claim 12, wherein said plasma deposition treatment is carried out with a power of the treatment electrical field that is substantially between 50 and 700 W.

15. The sole of claim 11, wherein a duration of said plasma deposition treatment for a siloxane-based monomer coating is between 160 seconds and 600 seconds.

16. The sole according to claim 15, wherein a duration of said plasma deposition treatment for a siloxane-based monomer coating is substantially equal to 420 seconds.

17. The sole of claim 11, wherein a vacuum level in said plasma deposition treatment is substantially between $10^{-1}$ mbar and $10^{-5}$ mbar.

18. The sole according to claim 1, wherein said plasma deposition treatment is a high-vacuum cold plasma treatment applied with a radiofrequency generator so that a treatment electrical field oscillates with a frequency on the order of 13.56 MHz, with an applied electrical field power equal to 50-700 W and a vacuum level between $10^{-1}$ mbar and $10^{-5}$ mbar.

19. The sole of claim 18, wherein a precursor material of the plasma deposition is a siloxane-based monomer.

20. The sole of claim 18, wherein a precursor material of the plasma deposition is an oil-repellent and water-repellent fluoropolymer.

21. The sole according to claim 1, wherein a material of said coating is a polysiloxane.

22. The sole according to claim 1, wherein a material of said coating is an oil-repellent and water-repellent fluoropolymer.

23. The sole according to claim 22, wherein said fluoropolymer is a commercially available material.

24. The shoe of claim 1, wherein said microporous upper layer that is permeable to water vapor is made of leather.

25. A waterproof breathable sole for shoes, comprising, for at least part of its extension, at least two structural layers, wherein a first structural layer is a lower layer provided with a supporting structure so as to form a tread, and a second structural layer is an upper microporous layer that is permeable to water vapor, said lower layer having two, upper and lower surfaces and portions that are open onto said upper layer, and wherein at least one of two surfaces of said upper layer comprises a coating formed by plasma deposition treatment for waterproofing, wherein said upper layer and said lower layer are joined hermetically along a perimeter region thereof in order to avoid water infiltrations, wherein said lower layer is constituted by a perimetric skirt that constitutes an outer edge of the sole, and by ground contact elements, which are made so as to support said upper layer, and wherein spaces of said lower layer comprised between each one of said ground contact elements, and between said ground contact elements and said skirt, form said portions, wherein said plasma deposition treatment is a high-vacuum cold plasma treatment applied with a radiofrequency generator so that a treatment electrical field oscillates with a frequency on the order of 13.56 MHz, with an applied electrical field power equal to 50-700 W and a vacuum level between $10^{-1}$ mbar and $10^{-5}$ mbar, and wherein a precursor material of the plasma deposition is an oil-repellent and water-repellent fluoropolymer.

* * * * *